US007278481B2

(12) United States Patent
Eken

(10) Patent No.: US 7,278,481 B2
(45) Date of Patent: Oct. 9, 2007

(54) METHOD AND SYSTEM FOR PRODUCING AN OIL AND GAS MIXTURE THROUGH A WELL

(75) Inventor: Adriaan Nicolaas Eken, Rijswijk (NL)

(73) Assignee: Shell Oil Company, Houston, TX (US)

( * ) Notice: Subject to any disclaimer, the term of this patent is extended or adjusted under 35 U.S.C. 154(b) by 211 days.

(21) Appl. No.: 10/491,273

(22) PCT Filed: Sep. 30, 2002

(86) PCT No.: PCT/EP02/10938

§ 371 (c)(1),
(2), (4) Date: Mar. 31, 2004

(87) PCT Pub. No.: WO03/029611

PCT Pub. Date: Apr. 10, 2003

(65) Prior Publication Data

US 2004/0244989 A1 Dec. 9, 2004

(30) Foreign Application Priority Data

Oct. 1, 2001 (EP) ..... 01203721

(51) Int. Cl.
*E21B 43/12* (2006.01)

(52) U.S. Cl. ..... 166/250.15; 166/386; 166/372; 166/53; 166/72; 166/91.1

(58) Field of Classification Search ..... 166/372, 166/53, 66, 72, 65.1, 386, 91.1, 250.15; 73/861.25
See application file for complete search history.

(56) References Cited

U.S. PATENT DOCUMENTS 2,298,834 A 10/1942 Moore ..... 103/4
2,607,220 A 8/1952 Martin ..... 73/151
3,638,731 A 2/1972 Driscoll ..... 166/314
4,790,378 A * 12/1988 Montgomery et al. ..... 166/66

(Continued)

FOREIGN PATENT DOCUMENTS

EP 0756065 1/1997

(Continued)

OTHER PUBLICATIONS

International Search Report dated Dec. 19, 2002.

(Continued)

*Primary Examiner*—Lanna Mai
*Assistant Examiner*—Matthew J. Smith

(57) ABSTRACT

A method and system are provided for controlling the production of oil and gas in a well such that the well operates at the edge of gas coning. Thereto the flow rate and/or pressure of the produced well effluents are controlled by a dynamically controlled choke such that continously a limited amount of gas is entrained in the produced crude oil, whereas full gas coning and breakthrough of gas from the gas cap is prevented. The choke may be controlled by a control system which includes an algorithm that takes wellhead temperatures, pressures and choke position as measured variables and which maintains the average bulk velocity of the well effluents at a substantially constant and relatively high level. Optionally, the system also maintains an optimal gas-to-liquid ratio of the well effluents.

10 Claims, 1 Drawing Sheet

U.S. PATENT DOCUMENTS

| | | | | |
|---|---|---|---|---|
| 5,014,789 | A | 5/1991 | Clarke et al. | 166/372 |
| 5,132,904 | A | 7/1992 | Lamp | 364/422 |
| 5,146,991 | A * | 9/1992 | Rogers, Jr. | 166/53 |
| 5,172,717 | A | 12/1992 | Boyle et al. | 137/155 |
| 5,176,164 | A | 1/1993 | Boyle | 137/155 |
| 5,826,659 | A | 10/1998 | Hershberger | 166/372 |
| 5,955,666 | A | 9/1999 | Mullins | 73/152.18 |
| 6,158,508 | A | 12/2000 | Casagrande et al. | 166/250.15 |
| 6,286,596 | B1 | 9/2001 | Schnatzmeyer et al. | 166/250.15 |
| 6,415,864 | B1 | 7/2002 | Chen et al. | 166/250.03 |
| 6,813,962 | B2 * | 11/2004 | Gysling et al. | 73/861.26 |
| 6,991,034 | B2 * | 1/2006 | Wilde | 166/91.1 |

FOREIGN PATENT DOCUMENTS

| | | |
|---|---|---|
| EP | 0840836 | 5/1998 |
| EP | 0945589 | 9/1999 |
| GB | 2252797 | 8/1992 |
| GB | 2325949 | 12/1998 |
| GB | 2342109 | 4/2000 |
| WO | 99/00277 | 1/1988 |
| WO | 97/04212 | 2/1997 |
| WO | 98/25005 | 6/1998 |
| WO | 00/00715 | 1/2000 |
| WO | 01/34940 | 5/2001 |
| WO | 01/65063 | 9/2001 |

OTHER PUBLICATIONS

SPE 57313, Gas Lift Optimization Efforts and Challenges, Y.C. Chia. 1999, Society of Petroleum Engineers Inc.

Oil & Gas Jrnl, Nov. 28, 1994, pp. 64-67, Adjunta et al. "Wellhead monitors automate Lake Maracaibo gas lift".

* cited by examiner

METHOD AND SYSTEM FOR PRODUCING AN OIL AND GAS MIXTURE THROUGH A WELL

The present application claims priority on European Patent Application 01203721.4 filed on 1 Oct. 2001.

FIELD OF THE INVENTION

The invention relates to a method and system for controlling production of a crude oil and gas mixture through an oil well that extends into an oil bearing formation layer which is located below a gas bearing formation layer.

BACKGROUND OF THE INVENTION

The well may be free flowing or may be started by means of lift gas injected to a down-hole location to reduce the density of the well effluents in the production tube. Dynamic control of lift gas injection into a production tubing is known from European patents No. 840836 and 945589 and from UK patent applications No. 2342109 and 2252797. These prior art references do not disclose measures to deal with effects of gas coning.

It is known that gas coning occurs if oil is produced from an oil bearing formation layer that is relatively thin and located below a gas bearing formation layer which is often referred to as the gas cap. A lower pressure at the bottom of the vertical production tubing will draw progressively harder on the oil in the reservoir, eventually drawing gas from the gas cap above the oil bearing formation layer.

It is common practice to adjust the size of the surface choke or bean such that the phenomena of gas coning is mitigated, thereby preventing the depletion of the gas cap and avoiding that the production of crude oil is reduced and the well predominantly produces gas from the gas cap.

If the critical drawdown is still exceeded unintentionally, possibly as a result of gradual changes to the reservoir, full gas coning will develop. This leads to substantially lower oil production and unwanted depletion of the gas cap. When gas coning has developed fully, it can only be stopped by taking back the well production substantially, leading to deferment.

International patent application WO98/25005 discloses a method of producing crude oil wherein a small amount of gas from a gas cap is injected into the production tubing and the gas injection rate is controlled by a downhole one way check valve, which is not adjustable and wear prone.

SUMMARY OF THE INVENTION

The method for producing an oil and gas mixture through a well according to the inventions comprises producing oil from an oil bearing formation layer which is located below a gas bearing formation layer wherein the well effluents pressure and/or well effluents fluid production rate is controlled by a production choke such that the oil-gas interface in the formation in the vicinity of the inflow zone is lowered and a limited amount of gas is entrained in the well effluents, wherein an algorithm adjusts the opening of the production choke if the well effluents velocity calculated by the algorithm deviates from a desired level during a period of less than 15 minutes, or even more preferably during a period of less than 5 minutes.

It is an object of the invention to provide a method and system which enable a well to produce oil while it is at the edge of gas coning, such that only a limited amount of gas from the gas cap is entrained with the produced crude oil, which gas reduces the density of the well effluents in the production tubing and therefore stimulates oil production from the well, but wherein full breakthrough of gas and substitution of oil production by gas production as a result of gas coning is prevented.

Generally the gas used for the above form of stimulation of oil production is re-injected into the reservoir through compression and injection via dedicated gas injection wells.

In this way the gas entrained in the oil stream will reduce the density of the well effluents in the production tubing and the resulting reduction of the pressure in the inflow region of the well will stimulate the production of oil. However full break-through of the gas cone into the well inflow region is prevented at the same time, since full breakthrough of the gas cone would significantly reduce the production of crude oil. Thus the method according to the invention balances the production of oil and gas such that the well still predominantly produces crude oil while the well is at the edge of gas coning.

Preferably the well effluents pressure and/or well effluents production rate is controlled by dynamically adjusting the opening of a production located downstream of the inflow zone of the well by an algorithm which calculates the average velocity of the well effluents on the basis of measured well data.

The production choke may be located at or near the wellhead and be controlled by an algorithm which calculates an average velocity of the well effluents at or near the wellhead and which adjusts the opening of the production choke in response to deviation of the calculated velocity from a selected velocity.

The velocity of the well effluents may be calculated by means of pressure sensors which measure a pressure difference across a flow restriction at or near the wellhead and an algorithm which calculates a well effluents velocity on the basis of the measured pressure difference across the flow restriction.

A fast response time of the production choke in response to measured variation of the production rate is important since an incoming gas surge or gas kick will usually result in an increased production rate at the wellhead within a period of a few minutes. The flow of crude oil from a well may however have natural velocity fluctuations which typically last less than about 5 to 15 minutes. These natural fluctuations may be filtered out by the algorithm by including a low pass filter in the algorithm which reduces fluctuations which last up to 5-15 minutes. The low pass filter may be programmed to recognise the typical pattern and duration of such natural fluctuations.

Possible filtering systems that can be used for this purpose are: moving average filters such as described in Yokogawa FCS Function Manual IM 33G3C10-11E-CS or exponential filters such as described by other Distributed Control System vendors.

Suitably, the algorithm incrementally decreases the opening of the production choke if the calculated well effluents velocity exceeds a predetermined value and incrementally increases the opening of the production choke-if the calculated well effluents velocity and/or mass flow is below a predetermined value.

A system for applying the method according to the invention comprises a variable choke for adjusting the flow of well fluids, a control module for dynamically controlling the opening of the choke on the basis of an algorithm which calculates the well effluents velocity and/or well effluents pressure on the basis of measured production data and pressure and choke position sensors at or near the wellhead for providing measured production and choke position data to the control module, wherein the algorithm is configured such that the algorithm adjusts the opening of the production choke if the well effluents velocity calculated by the algorithm deviates from a desired level during a period of less than 15 minutes, or even more preferably during a period of less than 5 minutes.

If the well is provided with lift gas injection means which inject gas at least during a start-up phase of the well in which no gas is sucked down into the well inflow region the system may further comprise a flow measurement and control system on the lift gas supply which receives a target setpoint for the lift gas injection flow rate from said control module.

The system according to the invention may be equipped with means to start-up the well according to a pre-set procedure of setting a start-up choke opening and lift gas supply, whilst taking into account variations in wellhead measurements.

The well may comprise a plurality of production tubes through which oil and gas is produced from different inflow zones located at different levels in the oil bearing formation.

The invention is based on insights derived from detailed analysis of the dynamic phenomena that occur during the build-up of gas coning which show that in transition from normal operation to gas coning there is a transient change in variables measured at the wellhead. These transient changes occur whilst the gas bubble gradually replaces the oil/gas mixture in the vertical production tubing starting at the bottom of the production tube.

Operational experience has shown that changing the opening of the production choke has an immediate effect on the pressure at the bottom of the production tubing, and thereby on the drawdown between the well inflow zone and the pore pressure in the surrounding oil and/gas bearing formation layers.

The control device according to the invention preferably dynamically controls the choke as a function of the changes in the wellhead measurements so that the gas bubble will be held back. The gas coning will not fully develop, and well production will continue as before. The early signs of gas coning enable the controller to maintain the well at its optimal production rate. This is achieved by adjustment of the target setpoint of the controller.

The target setpoint of the controller may be adjusted on the basis of an estimation of the gas-to-liquid ratio of the well fluids. This estimation may be based on observation of the temperature drop across the production choke compared with the pressure drop across the production choke.

DESCRIPTION OF A PREFERRED EMBODIMENT

Figure 1:
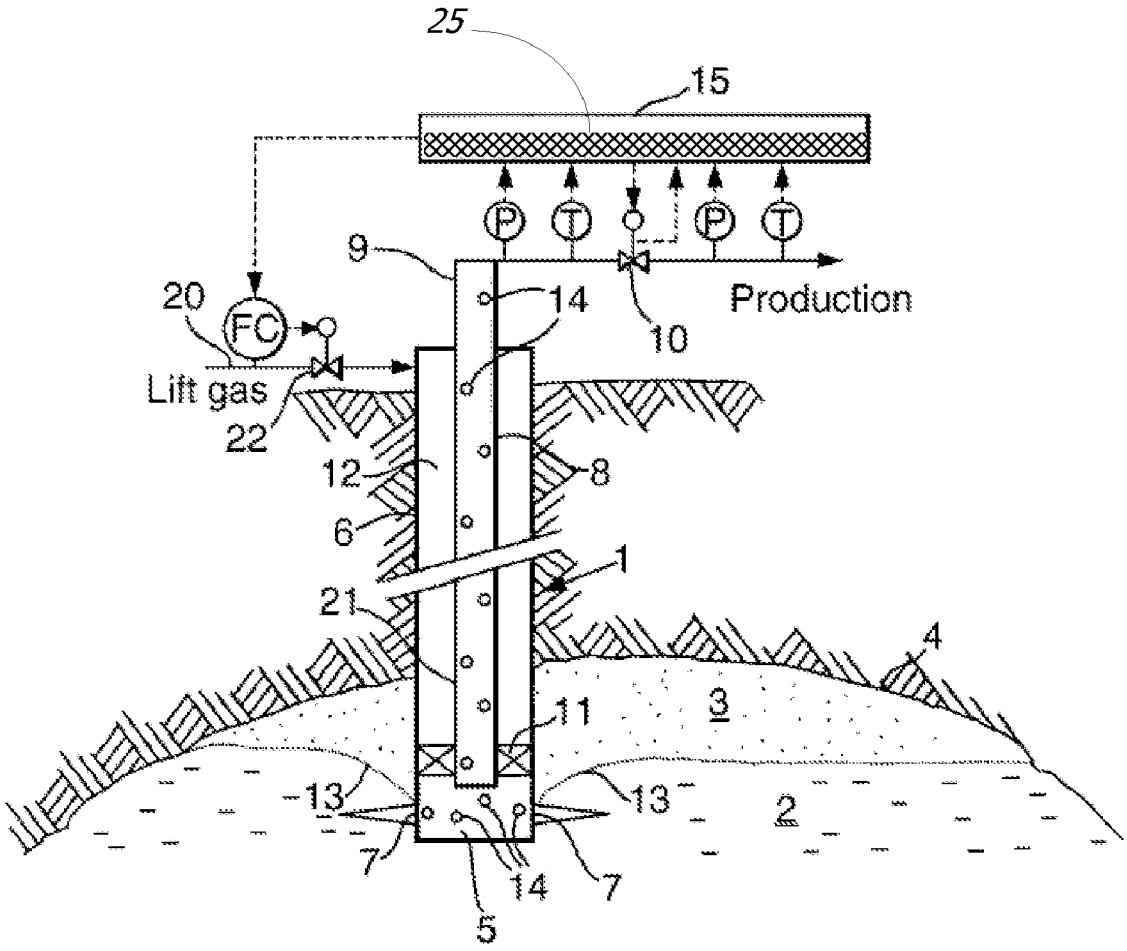
FIG. 1 schematically shows a well which is equipped with a dynamically controlled production choke according to the invention.

The invention will be described in more detail and by way of example with reference to the accompanying FIG. 1 which schematically shows a well which is equipped with a dynamically controlled production choke according to the invention.

In FIG. 1 a well 1 is shown which produces a mixture of crude oil from an oil bearing formation layer 2 and a minimal amount of gas from a gas bearing formation layer 3, which layers are located underneath a fluid impermeable cap formation 4.

The well 1 comprises an inflow zone 5 where the well casing 6 comprises perforations 7 through which formation fluids enter the wellbore.

A production tubing 8 is suspended from the wellhead 9 which is equipped with a production choke 10 which dynamically controls the production rate of well effluents through the well 1.

The production tubing 8 is near its lower end provided with a packer 11 which seals off the annular space 12 between the production tubing 8 and well casing 6.

The production choke 10 controls the production rate of well effluents at such a high level that a gas cone 13 begins to develop and gas bubbles 14 are entrained in the flow of crude oil, which enters the well inflow zone 5 via the perforations 7.

The gas bubbles 14 reduce the density of the fluid mixture in the production tubing 8 and therefore reduce the hydrostatic pressure in the well inflow region 5 and thus increase the drawdown between the well inflow region 5 and the surrounding formation so that the production of crude oil from the oil bearing formation layer 2 is stimulated.

The production choke 10 is equipped with a control module 15 which adjusts the opening of the production choke by an algorithm which aims to maintain the bulk flow of crude oil and gas constant and which calculates the bulk flow production rate of well effluents on the basis of pressure and optionally temperature measurements made by pressure sensors (p) and temperature sensors (T) which detect the pressure and temperature upstream and downstream of the production choke 10. The algorithm then calculates the bulk flow production velocity and bulk flow production rate on the basis of Bernouilli's law.

Optionally the well 1 is provided with a lift gas supply system 20 which injects lift gas via the annular space 12 and an orifice 21 into the production tubing 8 in order to further reduce the density of the well effluents in the production tubing 8. The lift gas supply system 20 is equipped with a lift gas injection control valve 22 which has a target setpoint which is controlled by the control module 15. The injection of lift gas may be confined to a start-up phase of the well 1 and be terminated when a sufficient amount of gas is entrained in the crude oil produced. Alternatively the injection of lift gas may continue for as long as crude oil production via the well 1 takes place, whereas the lift gas injection rate may be reduced to a pre-set low level after the start up phase of the well.

During the start-up phase the production choke 10 and lift gas injection valve 22 may be controlled manually by an operator and/or by the control module 15, wherein the operator may adjust and tune the settings of the control module 15.

Preliminary studies have indicated that a rapid partial closure of the production choke 10 within minutes after an increase of bulk production is detected by the control module 15 is sufficient to suppress the development of a full gas cone which could cause the gas from the gas bearing formation layer 3 to bypass the oil from the oil bearing formation layer 2. Preferably the response time to partially close the production choke 10 in response to a calculated increase of the bulk production velocity and/or rate is less than 5 to 15 minutes, whereas natural velocity fluctuations of a duration less than 5-15 minutes are recognized and reduced by a low pass filter 25 included in the algorithm in control module 15.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. A method for producing an oil and gas mixture through a well, the method comprising:

producing oil from an oil bearing formation layer which is located below a gas bearing formation layer; and controlling the well effluents pressure and/or well effluents fluid production rate through adjustment of a production choke such that the oil-gas interface in the formation in the vicinity of the inflow zone is lowered and a limited amount of gas is entrained in the well effluents; wherein the production choke is controlled by an algorithm such that the algorithm adjusts the opening of the production choke if the well effluent velocity calculated by the algorithm deviates from a pre-selected level during a period of less than 15 minutes;

wherein the algorithm includes a low pass filter, which reduces velocity fluctuations of about 5-15 minutes.

2. The method of claim 1, wherein the step of controlling well effluents pressure and/or well effluents production rate includes the step of dynamically adjusting the opening of a production choke located downstream of the inflow zone of the well by an algorithm which calculates the downhole pressure in the inflow zone of the well on the basis of measured well data.

3. The method of claim 1, wherein the step of controlling well effluents pressure and/or production rate includes the step of dynamically adjusting the opening of a production choke located in the flow path of the well downstream of the well inflow zone by an algorithm which calculates an average velocity of the well effluents on the basis of production rate measurements and which adjusts the opening of the production choke in response to deviation of the calculated velocity from a selected velocity.

4. The method of claim 3, wherein the production choke is located at the wellhead of the well and the pressure of the well effluents is measured by pressure sensors which measure a pressure difference across a flow restriction at or near the wellhead and an algorithm calculates the average velocity of the well effluents on the basis of the measured pressure difference across the flow restriction.

5. The method of claim 1, wherein the algorithm incrementally decreases the opening of the production choke if the calculated well effluent velocity exceeds a predetermined value and incrementally increases the opening of the production choke if the calculated well effluent velocity pressure is below a predetermined value; wherein the algorithm includes a low pass filter, which reduces velocity fluctuations of up to 5-15 minutes.

6. A system for use in the method for producing an oil and gas mixture through a well of claim 1, the method comprising:

a variable production choke for adjusting the flow of well fluids;

a control module for dynamically controlling the opening of the choke on the basis of an algorithm which calculates the well effluents velocity and/or well effluents pressure on the basis of measured production data; and pressure, temperature and choke position sensors at or near the wellhead for providing measured production and choke position data to the control module; wherein the algorithm is configured such that the algorithm adjusts the opening of the production choke if the well effluent velocity calculated by the algorithm deviates from a pre-selected level during a period of less than 15 minutes wherein the control module comprises a low pass filter.

7. The system of claim 6, wherein the well is provided with lift gas injection means for use during the start of a well and the system further comprises a flow measurement and control system on the lift gas supply which receives a target set-point for the lift gas injection pressure from said control module.

8. The system of claim 6, with provisions to start-up the well according to a pre-set procedure of choke opening and lift gas target set-point, whilst taking into account variations in wellhead measurements.

9. The system of claim 6, wherein the well comprises a plurality of production tubes through which oil and gas is produced from different inflow zones located at different levels in the oil bearing formation.

10. The system of claim 6, further comprising of a gas-to-liquid estimation assembly which measures differential temperature and differential pressure across the production choke and uses a measured relationship between said measured pressure and temperature differences to generate an estimated gas-to-liquid ratio of the produced well effluents and the output of the gas-to-liquid estimation assembly is connected to the control module for adjusting a set-point of said control module.

* * * * *